United States Patent [19]

Neumann

[11] 4,396,511

[45] Aug. 2, 1983

[54] CLEANING APPARATUS FOR CURVED FILTER SCREENS

[75] Inventor: Karl Neumann, Aarbergen, Fed. Rep. of Germany

[73] Assignee: Passavant-Werke Michelbacher Huette, Fed. Rep. of Germany

[21] Appl. No.: 206,306

[22] Filed: Nov. 12, 1980

[30] Foreign Application Priority Data

Oct. 31, 1979 [DE] Fed. Rep. of Germany ..... 2944047

[51] Int. Cl.[3] ..... B01D 35/08

[52] U.S. Cl. ..... 210/413; 210/159

[58] Field of Search ..... 210/159, 413

[56] References Cited

U.S. PATENT DOCUMENTS

| | | | |
|---|---|---|---|
| 1,794,504 | 3/1931 | Norman | 210/159 |
| 1,801,111 | 4/1931 | Schofield et al. | 210/159 |
| 2,009,005 | 7/1935 | Schofield et al. | 210/159 |
| 2,086,821 | 7/1937 | Raisch | 210/159 |
| 3,909,411 | 9/1975 | Angele et al. | 210/159 |
| 4,107,040 | 8/1978 | Rudolph et al. | 210/413 |

*Primary Examiner*—Ivars C. Cintins

*Attorney, Agent, or Firm*—Woodford R. Thompson, Jr.

[57] ABSTRACT

A boom is mounted for pivotal movement about the center from which the arcuate shape of a filter screen is struck and a cleaner is pivoted to the free end of the boom. A single reversible drive unit is operatively connected to the cleaner for exerting a force thereto to tilt the cleaner toward a cleaning position. A stop operatively and rigidly connects the cleaner to the boom to transmit force from the cleaner to the boom as a pivotal force only after the cleaner is tilted to the cleaning position to thus rigidly connect the drive unit and cleaner to the boom.

16 Claims, 4 Drawing Figures

CLEANING APPARATUS FOR CURVED FILTER SCREENS

BACKGROUND OF THE INVENTION

This invention relates to cleaning apparatus for curved filter screens and more particularly to such apparatus which includes a boom mounted for pivotal movement about the center from which the arcuate shape of the screen is struck, by means of a reversible drive unit, and a cleaner pivotally connected to the boom and movable up and down on the screen by pivoting the boom and being tiltable relatively to the boom by drive means between a return and/or throw-off position tilted away from the screen and a cleaning position on the screen, which are respectively determined by stops.

A cleaning device of this type is disclosed in German Pat. No. 2 502 725, wherein separate drive devices are provided for pivoting the boom and for tilting the cleaner, which may be in the form of hydraulic cylinders or shafts driven by electric motors. Due to these two separate drive devices and to the necessary mutual coordination of their controls, such prior art apparatus is complicated and expensive.

SUMMARY OF THE INVENTION

It is an object of my invention to simplify the drive means for imparting pivotal movement to the pivot boom and tilting movement to the cleaner. This is achieved according to my invention by providing a single reversible drive unit for pivoting the boom and for tilting the cleaner with the drive unit being connected to the cleaner in such a way that its force exerts a tilting force upon the cleaner which is then transmitted to the boom as a pivoting force. After the cleaner has completed its tilting stroke it is anchored rigidly by abutment against a stop on the boom.

My improved drive unit thus utilizes a structure wherein it acts solely upon and tilts the cleaner without thereby transmitting a driving force to the boom. It then exerts a pivoting force upon the boom as soon as the cleaner has completed its tilting stroke and abuts against a stop to thereby rigidly connect the drive means to the boom. In comparison to the prior art apparatus mentioned above, my improved drive unit is more economical to manufacture and use and eliminates the requirement of means for the mutual coordination of two separate drives. The coordination of the tilting and pivoting movements is obtained automatically due to the fact that during the tilting of the cleaner the boom is not driven whereby the force of the drive unit is exerted as a pivoting movement for the boom only after the cleaner has completed its tilting stroke.

According to a preferred embodiment of my invention, the stop determining the cleaning position of the cleaner is constructed so that it ceases to function as a stop at the end of the upward movement of the boom, so that after the cleaner is released it is once more tiltable relative to the boom into a throw-off position by the force of the drive unit continuing to act upon it. Accordingly, without providing additional drive means, I provide a throw-off movement of the cleaner to throw off the screen material collected by it, and at the same time no stripper is necessary to strip the screen material out of the cleaner. Since this tilting movement occurs abruptly, the screen material not only slides off, but is actually thrown off. Also, a great throw-off height can be achieved by this means.

In a preferred embodiment of my invention, the stop determining the cleaning position of the cleaner comprises guide members on the screen, which are engaged by sliding or rolling elements carried by the cleaner. Such guide members may be carried by the outermost grating bars of the curved screen, which may conveniently be in the form of projections which extend upwardly and downwardly beyond the upper and lower ends of the screen. There is an advantage in this construction in that the cleaning device is also suitable for use with inaccurately curved or inaccurately installed screens, since the cleaner can immediately follow the inaccuracies. Such inaccuracies may also be in the form of short straight screen sections.

Instead of the cleaner abutting against the screen, the work position of the cleaner relative to the boom may also be determined by means of a releasable stop or ratchet which rigidly anchors the cleaner, or a member connecting it to the drive unit, to the boom and which is releasable at the upper end of travel of the boom.

DESCRIPTION OF THE DRAWINGS

Apparatus embodying features of my invention is illustrated in the accompanying drawings forming a part of this application, in which.

DETAILED DESCRIPTION

Figure 1:
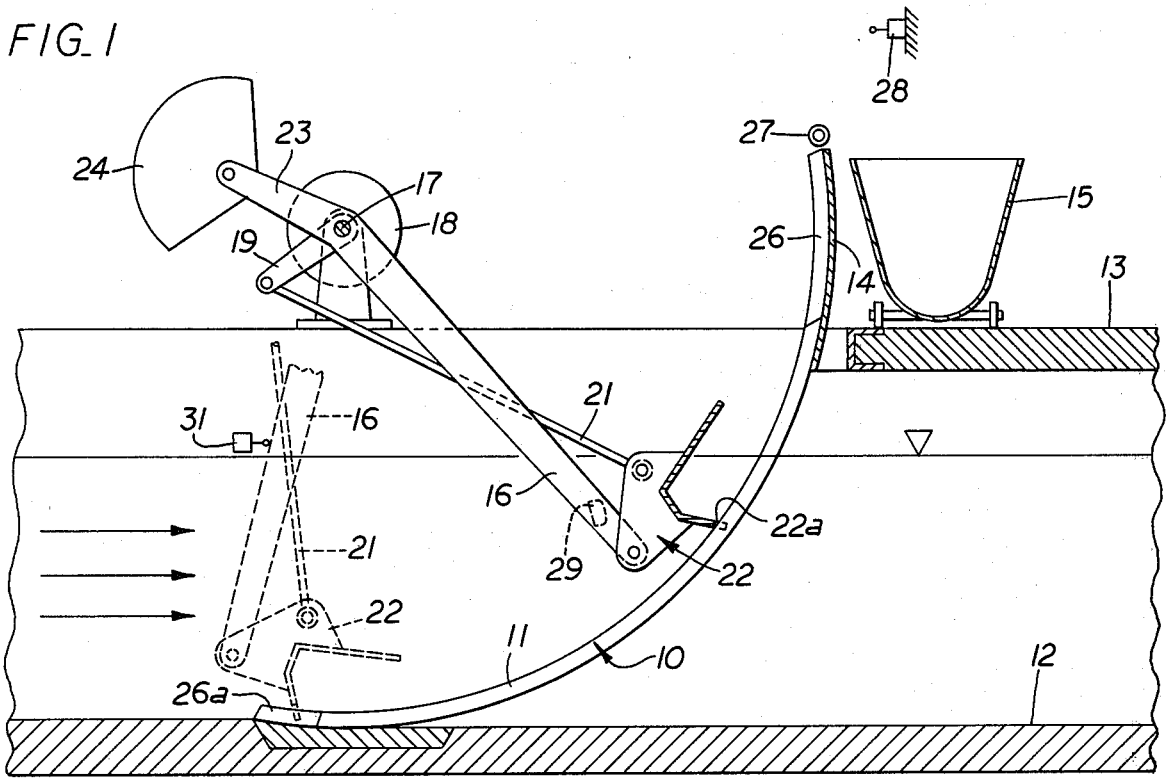
FIG. 1 is a schematic side elevational view, partly in section, showing a curved filter screen associated with cleaning apparatus according to one embodiment of my invention with the cleaner in the cleaning position.

Referring now to FIG. 1, I show a curved filter screen 10 having the usual curved grating bars 11. The filter screen 10 is mounted in a channel 12 through which the sewage to be purified flows with the screen 10 continuing above the liquid level and above the operating platform 13. An apron 14 is provided at the upper end of the screen, as shown. Also, a bucket truck 15 is provided as a collecting and transport device.

A boom 16 is mounted for free rotation on a shaft 17 driven by a gear motor 18. The shaft 17 is located as accurately as possible at the center from which the arcuate shape of the curved screen 10 is struck. The driven shaft 17 is connected rigidly to a crank arm 19. Pivotally connected to the free end of the crank arm 19 is a connecting rod 21, which in turn is pivotally connected at its other end to a cleaner fork 22 which is pivotally attached to the boom 16 whereby the cleaner fork is tiltable relative to the boom. In FIG. 1 the boom 16 is shown as having a projection 23 which extends beyond its pivot point and carries a counterweight 24.

Figure 4:
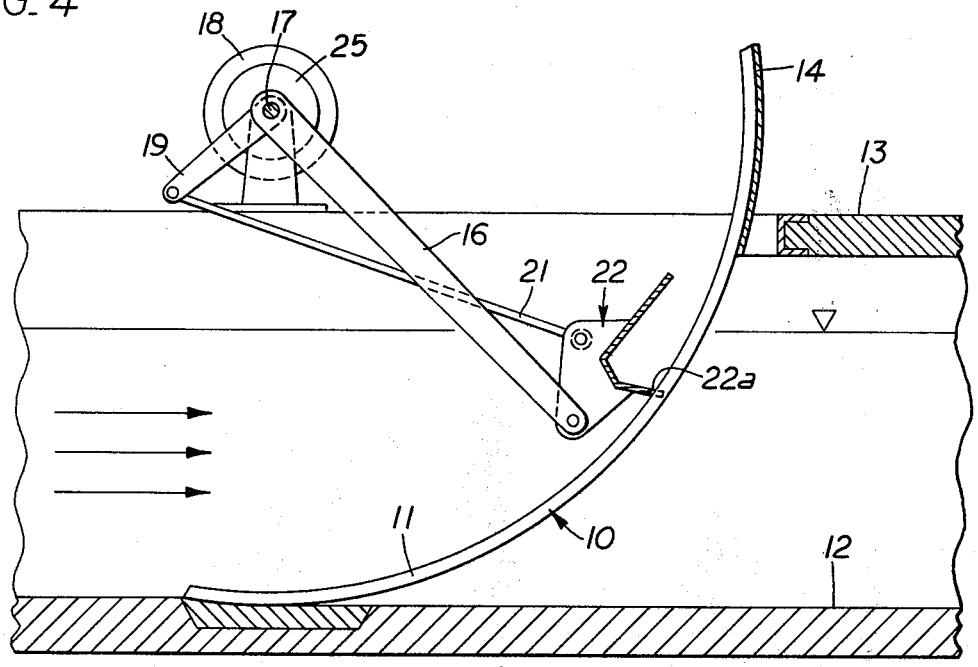
FIG. 4 is a view similar to FIG. 1, showing a further embodiment of my invention.

FIG. 4 shows an alternative for the counterweight 24 wherein the boom 16 may be braked during downward pivotal movement thereof by a conventional type brake 25, which acts through a freewheel to engage the hub for the boom only when the boom is rotating in a direction for the free end thereof carrying the cleaner fork 22 to be lowered.

In the position illustrated in solid lines in FIG. 1 during upward travel of the cleaner fork 22, the driving force of the motor 18 acts through the connecting rod 21 upon the cleaner fork 22 and urges the latter against the screen 10. Through suitable sliding elements 22*a*, rollers or the like the driving force of the motor 18 acts upon certain screen bars, preferably the two outermost bars, which thus constitute guide members 26 that extend upwardly as far as a throw-off point, as shown. So long as the cleaner fork 22 is in abutment against the guide members 26, the crank arm 19, connecting rod 21, cleaner fork 22 and boom 16 constitute a rigid four-bar linkage, through which the force of the motor 18 is transmitted to impart upward pivotal movement to the boom 6. By selecting the proper pivot points, the cleaner fork 22 may be urged more firmly against the screen bars 11 with increased cleaning resistance, so that even jammed screen material can be eliminated in a reliable manner.

Figure 2:
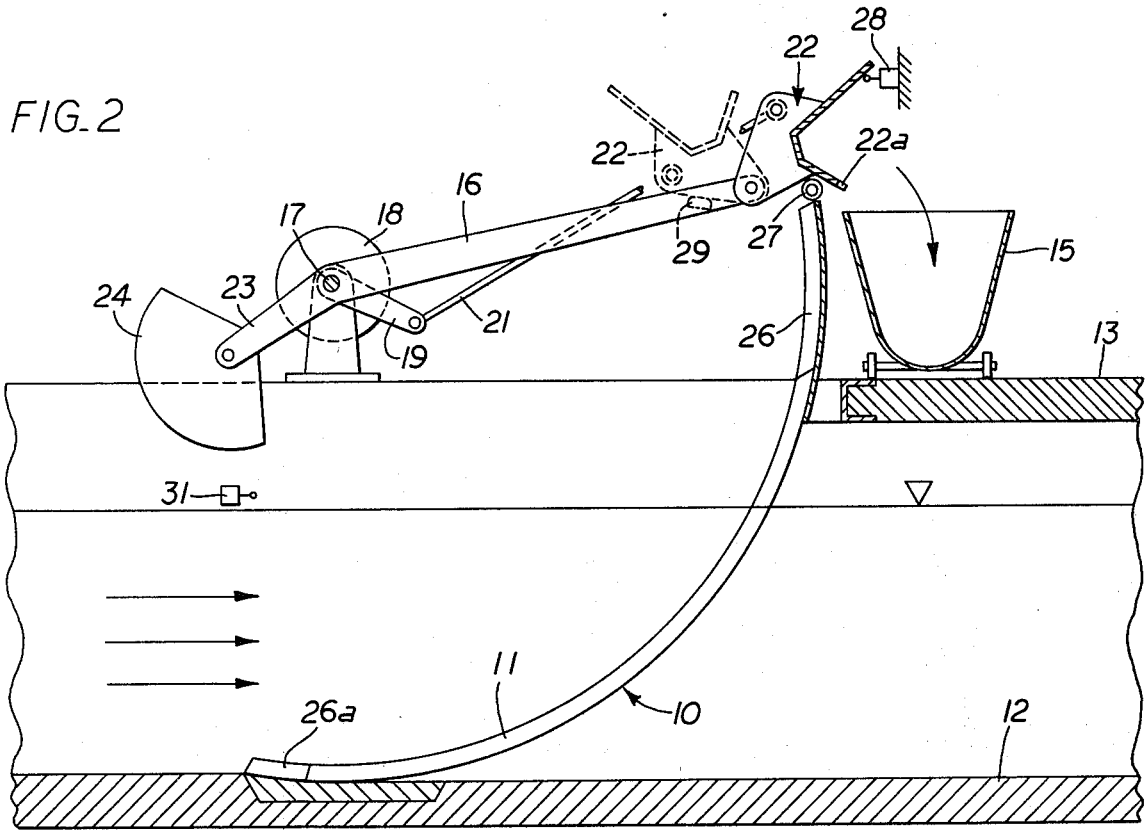
FIG. 2 is a view corresponding generally to FIG. 1 but showing the cleaner in the throw-off position.

At the upper end of the apron 14 the stop for the cleaner fork 22 terminates, so that the boom 16 is no longer driven and thus stands still. The connecting rod 21 then tilts the cleaner fork 22 forward beyond the arc of the curved screen whereupon the screen material is automatically discharged into the bucket truck 15, as shown in FIG. 2. Accordingly, chutes or similar guide members are eliminated. During tilting movement of the cleaner fork 22 it may slide over a rounded upper extremity of the apron 14, or pass over a roller 27 which supports the cleaner fork without preventing fibers suspended from the fork tines from being thrown off, as shown in FIG. 2.

At the end of the tilting movement of the cleaner fork 22, a limit switch 28 is actuated which reverses the direction of rotation of the motor 18. Due to the fact that the boom 16 with its counterweight 24 is weighted in such a way that a dead-weight force acts in the upward direction of rotation, or counterclockwise as viewed in FIG. 2, the cleaner fork 22 is initially tilted back with no movement of the boom 16. That is, it is tilted backward beyond its work position into the return position, where it is retained by a stop 29. Accordingly, a rigid four-bar linkage is again produced, so that the driving force of the motor 18 now also pivots the boom 16 downwards. In the backward tilted position the cleaner fork 22 is spaced a sufficient distance from the grating 11, so that all layer thicknesses of screen material occurring in practice are passed over.

In the lower limit position, in which the counterweight force is practically nil, the direction of rotation of the motor 18 is again reversed by a further limit switch 31, whereby the cleaner fork is automatically tilted into the cleaning position as shown in FIG. 1. In this position outer support elements of the cleaner fork 22 come to bear upon guide members 26*a* defined by the lower ends of the two outermost bars 11, which extend beyond the lower ends of the remaining grating bars 11 for this purpose.

The reversible motor 18 may be an electric, hydraulic or pneumatic motor, which may drive the shaft 17 through a gear of a desired construction. The drive means may also be a hydraulic or pneumatic cylinder which engages the crank arm 19 directly or another crank for imparting pivotal movement to the cleaner fork 22. The length proportions and positions of the pivot points of the four-bar linkage are chosen so that, on the one hand, a sufficient cleaning force can be built up, while on the other hand, the drive means does not become blocked by an increase in the frictional force created by the cleaning resistance.

Figure 3:
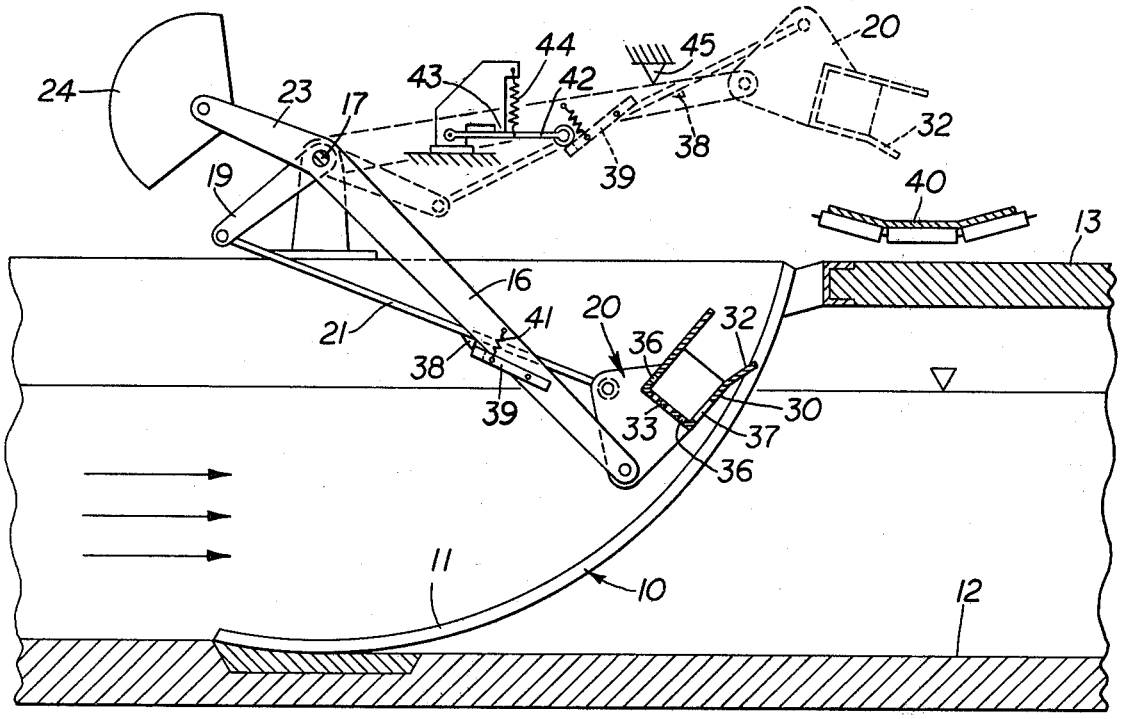
FIG. 3 is a view similar to FIG. 1 showing another embodiment of my invention.

In the embodiment shown in FIG. 3 the front side 30 of a cleaner fork 20 has a fork rail 32 which extends upwardly and then forwardly toward the screen 11 so that the working edge of the fork rail engages the screen at a very acute angle relative to a line approximately tangent to the arcuate interior profile of the screen. The screen material is thus peeled off correctly and jamming cannot occur. The bottom of the cleaner fork 20 is trough-shaped with its bottom wall 33 and lower section of its rear wall 34 containing drip apertures 36 for preliminary drainage of the screen material. Apertures, preferably in the form of vertical slits 37, are provided in the front wall 30 so that they do not obstruct the throw-off of the screen material onto a conveyor 40.

The connecting rod 21 of the embodiment shown in FIG. 3 is provided with a ratchet having a locking nose 38 which cooperates with a catch lever 39 whereby the cleaner fork is maintained at a short distance from the screen 10 during its cleaning travel. The locking nose 38 is mounted on the connecting rod 21 and the catch lever 39 is connected to the boom 16. The catch member 39 is retained in its upper position by a tension spring 41 whereby it limits movement of the connecting rod 21 as it travels forward to pivot the fork 20 inward. Just before reaching the top throw-off position the catch lever 39 is unlocked by a fixed stop lever 42. Accordingly, the connecting rod 21 can travel forwardly and initiate the throw-off operation. The stop bar 42 is drawn against an upper stop 43 by a tension spring 44. The stop bar 42 can escape downwardly from the catch lever 39 which is resiliently held from above by the spring 44.

In the embodiment shown in FIG. 3 having the ratchet and trough-shaped cleaner fork 20, an apron at the upper end of the screen 10 is unnecessary. The uppermost position of the boom 16 can be obtained and precisely maintained by a fixed stop 45.

In all embodiments, the apparatus is switched on from the rest position of the boom 16 as shown in dotted lines in FIG. 1, by the limit switch 31 whereby after throwing off the screen material and being switched back to return, the cleaner fork is tilted fully backwardly, while the boom still occupies the top position. In automatic operation switching on may occur in the usual manner as a function of the level difference or by a work time/-pause control.

What I claim is:

1. Cleaning apparatus for a filter screen comprising:

(a) a curved filter screen in the shape of a circular arc, (b) a boom mounted for free pivotal movement about the center of the circular arc of said screen, (c) a cleaner pivotally connected to the end of said boom and movable up and down relative to said screen upon pivotal movement of said boom and being tiltably relative to said boom, (d) a single reversible drive unit operatively connected by a connecting rod to said cleaner for exerting a force thereto to tilt said cleaner toward a cleaning position on the screen and to a return position tilted away from the screen, and (e) stop means operatively and rigidly connecting said cleaner to said boom and transmitting said force from said cleaner to said boom as a pivotal force only after said cleaner is tilted to said cleaning position and said return position, respectively.

2. Cleaning apparatus as defined in claim 1 in which said stop means determining the cleaning position of the cleaner is positioned so that it terminates at the end of the upward movement of the boom and the cleaner so that after being released from the stop means the cleaner is once more tiltable relative to the boom into a throw-off position by the force of the drive unit continuing to act upon it.

3. Cleaning apparatus as defined in claim 1 in which the stop means defining the cleaning position of the cleaner comprises a guide member on the screen in position to be engaged by a contact element on the cleaner.

4. Cleaning apparatus as defined in claim 1 in which the stop means determining the cleaning position of the cleaner comprises cooperating engaging members which detachably and operatively anchor said cleaner relative to said boom and is releasable by a fixed stop mounted adjacent the end of the upward travel of said boom.

5. Cleaning apparatus as defined in claim 1 in which the stop determining the return position of the cleaner is mounted on the boom.

6. Cleaning apparatus as defined in claim 1, 2, 3 or 5 in which the drive unit is connected to said connecting rod by a crank arm mounted coaxially with the boom so that the crank arm, connecting rod, cleaner and boom constitute a four-bar linkage.

7. Cleaning apparatus as defined in claim 6 in which the connecting rod crosses the boom.

8. Cleaning apparatus as defined in claim 1, 2, 3 or 5 in which said boom having the cleaner pivotally connected thereto is balanced with reference to its pivot point by a counterweight.

9. Cleaning apparatus as defined in claim 1, 2 or 3 in which the boom is operatively connected to a brake which is operative in its downward pivoting direction.

10. Cleaning apparatus as defined in claim 1, 2, 3 or 5 in which the drive unit urges the cleaner toward the screen and pivots the cleaner in a direction opposite to the upward pivotal direction of movement of the boom.

11. Cleaning apparatus as defined in claim 1, 2, 3 or 5 in which the direction of engagement of the working edge of the cleaner is oriented at an acute angle relative to a line approximately tangent to the arcuate interior profile of the screen.

12. Cleaning apparatus as defined in claim 11 in which the cleaner is in the form of a trough with discharge apertures for water.

13. Cleaning apparatus as defined in claim 3 in which the guide member extends upwardly beyond the screen.

14. Cleaning apparatus as defined in claim 13 in which the guide member comprises two outermost grating bars of the screen.

15. Cleaning apparatus as defined in claim 2 in which a roller member supports the cleaner during the tilting movement into the throw-off position.

16. Cleaning apparatus as defined in claim 1, 2, 3, 5, 13, 14 or 15 in which limit switches are associated with the limit positions of the boom and/or of the cleaner to reverse the drive unit.

* * * * *